US006242391B1

(12) United States Patent
Fukutani et al.

(10) Patent No.: US 6,242,391 B1
(45) Date of Patent: Jun. 5, 2001

(54) WATER-SOLUBLE CUTTING FLUID

(75) Inventors: Yasuo Fukutani, Kanzaki-Gun; Eiichiro Nakayama; Yukio Wada, both of Hikone; Shunji Suzuki, Yokkaichi, all of (JP)

(73) Assignee: Yasio Fukutani, Shiga (JP)

( * ) Notice: Subject to any disclaimer, the term of this patent is extended or adjusted under 35 U.S.C. 154(b) by 0 days.

(21) Appl. No.: 09/486,211

(22) PCT Filed: Jun. 18, 1998

(86) PCT No.: PCT/JP98/02743

§ 371 Date: Feb. 18, 2000

§ 102(e) Date: Feb. 18, 2000

(87) PCT Pub. No.: WO99/66014

PCT Pub. Date: Dec. 23, 1999

(51) Int. Cl.[7] ..... C10M 173/02; C10M 125/00

(52) U.S. Cl. ..... 508/180; 508/154; 72/42

(58) Field of Search ..... 72/42; 508/180, 508/154

(56) References Cited

U.S. PATENT DOCUMENTS

| | | | | |
|---|---|---|---|---|
| 3,669,858 | * | 6/1972 | LaBoda | 204/143 M |
| 3,750,847 | * | 8/1973 | Sluhan | 184/1 E |
| 4,366,077 | * | 12/1982 | Andrew et al. | 252/49.3 |
| 4,406,812 | * | 9/1983 | Childers | 252/186.21 |
| 5,061,389 | * | 10/1991 | Reichgott | 252/49.3 |

FOREIGN PATENT DOCUMENTS

| | | | |
|---|---|---|---|
| 62-290136 | * | 12/1987 | (JP) . |
| 62-290137 | * | 12/1987 | (JP) . |
| WO99/66014 | * | 12/1999 | (WO) . |

* cited by examiner

*Primary Examiner*—Ellen M. McAvoy
(74) *Attorney, Agent, or Firm*—Milde, Hoffberg & Macklin, LLP

(57) ABSTRACT

A water-soluble cutting fluid which is characterized by excellent cooling and lubricating properties and does not exert a harmful influence on the environment. A solution containing hydrogencarbonate ion, bromide ion, carbonic acid ion, and, if necessary, fluoride ion, and being adjusted to a pH of 7.0 to 11.5 can be used as a substitute for a cutting oil. A water-soluble cutting fluid further including additives such as rust-preventive agents and the like can be also used as a substitute for conventional cutting oil.

6 Claims, No Drawings

WATER-SOLUBLE CUTTING FLUID

FIELD OF THE INVENTION

The present invention relates to a water-soluble cutting fluid. More particularly, the invention relates to a water-soluble cutting fluid, which can be used as a substitute for a cutting oil to cut metals and such nonmetals as glasses and ceramics.

BACKGROUND OF THE INVENTION

Cutting metals such as an iron, aluminum, and various types of alloys, and nonmetals such as glasses, ceramics, special earthenware and reinforced plastics is one of the working processes for removing unnecessary parts from a workpiece with the use of a cutting tool to provide a desired shape, size or surface to the workpiece. In any cases of cutting, big friction occurs between a workpiece and a tool. Frictional heat burns the tool and makes the machined surface of the workpiece rough, and thermal expansion lowers the accuracy of the shape and the size of the workpiece and the tool, thus causing various problems. To reduce the above problems, a cutting fluid or a lubricant has been employed in cutting.

Water-soluble and water-insoluble cutting oils are commonly used as a cutting fluid or a lubricant to cut metals. A typical example of water-insoluble cutting oils is an oil solution including mineral oil, sulfur, and chlorine. The disadvantage of the oil solution is that it can be used only when the cutting temperature is low because high cutting temperature may cause the production of fire and smoke. In the meanwhile, a water-soluble cutting oil including mineral oil and the like, to which soap and sulfate are added as an emulsifier or higher alcohol and fatty acid ester are added as a binder, can be used. It is generally used after being diluted with water. Such a water-soluble cutting oil has an excellent lubricity, but on the other hand, it has low cooling property.

Water-insoluble cutting oils can be used repeatedly in cutting operation. However, the bacteria propagates in cutting oil as time goes by, and the cutting oil gives off a bad smell by the bacteria itself or the gas produced by the bacteria. The disposal of the used cutting oil has become the serious problem because the oil and emulsifier in the cutting oil inflicts a bad influence on the environment when said fluid is discharged as a waste liquid.

To prevent decay and offensive smell, antiseptic agent, mildewproof agent, and/or antibacterial substances such as amine, amide, amino acid have been added to water-soluble cutting oil. However, these agents and substances lower the quality of water-soluble cutting fluid as oil solution.

One of the objectives of the present invention is to provide a water-soluble cutting fluid, which is mainly used to cut metals and nonmetals, has an excellent lubricity and cooling property, prevents abrasion of a cutting tool, and can extend service life of a tool.

Another objective of the present invention is to provide a water-soluble cutting fluid, which can be used a number of times, does not provide a nutrient media for bacteria growth, and does not include environmentally-hazardous substances.

DISCLOSURE OF THE INVENTION

As the result of our researches to remove the above disadvantages, we have eventually completed the present invention, namely, a water-soluble cutting fluid, which contain no or little perishable organic substances, and no oil component as a base.

A water-soluble cutting fluid of the present invention contains bromide ion, carbonic acid ion ($CO_3^{2-}$) and hydrogencarbonate ion ($HCO_3^-$), which is adjusted to pH 7.0 to 11.5. A water-soluble cutting fluid of the present invention may further contain such cations as sodium ion and potassium ion.

Said cutting fluid can be obtained by dissolving sodium carbonate and sodium bromide in water. However, a method for preparing a water-soluble cutting fluid of the present invention is not limited by the above method. It may contain other cations such as potassium as a substitute for sodium.

A water-soluble cutting fluid of the present invention may further contain fluoride ion in addition to bromide ion, carbonic acid ion and hydrogencarbonate ion.

A water-soluble cutting fluid of the present invention may contain sodium carbonate, sodium hydrogencarbonate, sodium bromide and sodium fluoride, however, it is not limited by the above.

Preferably, a water-soluble cutting fluid of the present invention may contain 0.1 to 10 wt % of sodium carbonate and 0.005 to 1 wt % of sodium bromide. Such water-soluble cutting fluid is suitable for grinding, abrasive machining such as honing, lapping, and polishing. In another preferred embodiment, a water-soluble cutting fluid may contain 0.1 to 10 wt % of sodium carbonate, 0.1 to 10 wt % of sodium hydrogencarbonate, 0.005 to 1 wt % of sodium bromide, and 0.01 to 1 wt % of sodium fluoride. Such water-soluble cutting fluid is suitable for metal-cutting, drilling, and the like.

A water-soluble cutting fluid may further contain additives. Said additives may be one or more kinds selected from a group consisting of alcohols solvents, rust-preventive agents, antiseptic agents and brighteners, however, they are not limited by the above.

The term, "cutting", is used herein in a comprehensive sense, i.e., to broadly refer to cutting metals and nonmetals such as cutting with an edge tool, turning, drilling, planing and milling, grinding with abrasive grain such as honing and lapping, and polishing wafer of semiconductor or the like. It is not limited to cutting work of metals, glasses, plastics and the like, but includes rock drilling by shield tunneling method or the like.

DESCRIPTION OF THE PREFERRED EMBODIMENTS

A water-soluble cutting fluid of the present invention can be obtained by dissolving bromide ion, carbonic acid ion, and hydrogencarbonate ion in water such as demineralized water, distilled water, and the like, which has a melting point of about 0° C., a boiling point of about 100° C. and a density of about 1.00 g/cm$^3$ at the temperature of 4° C., and then being adjusted to pH 7.0 to pH 11.5.

A water-soluble cutting fluid of the present invention can be also obtained by dissolving bramide ion, carbonic acid ion, hydrogencarbonate ion, and fluoride ion in demineralized water, distilled water, which has a melting point of about 0° C., a boiling point of about 100° C. and a density of about 1.00 g/cm$^3$ at the temperature of 4° C., and then being adjusted to pH 7.0 to pH 11.5.

Alternatively, a water-soluble cutting fluid of the present invention can be obtained by dissolving bromide ion, carbonic acid ion, hydrogencarbonate ion, and, if necessary, fluoride ion in alkaline components of a tap water extracted by electrolyzing the tap water.

A method for dissolving bromide ion, carbonic acid ion, hydrogencarbonate ion, and, if necessary, fluoride ion in water is not particularly limited and any conventional method well-known by the persons skilled in the art can be used in the present invention. One of the direct and easy methods is the method for dissolving a suitable amount of compounds containing bromide, fluorine, hydrogencarbonate or carbonic acid in water. Such compound is not particularly limited. Any compound containing one or more kinds selected from the group consisting of bromide, fluorine, hydrogencarbonate and carbonic acid, which are known by the persons in the art, can be used. For example, potassium bromide, sodium bromide, potassium bromide dehydrate, potassium hydrogen bromide, ammonium bromide, ammonium hydrogen bromide, sodium hydrogen bromide, potassium fluoride, potassium fluoride dihydrate, potassium hydrogen fluoride, ammonium fluoride, ammonium hydrogen fluoride, sodium fluoride, sodium hydrogen fluoride, sodium hydrogencarbonate, sodium carbonate, sodium carbonate monohydrate, potassium hydrogencarbonate, ammonium hydrogencarbonate and the like can be used. The method for blowing gaseous carbon dioxide directly to water can be also used as one of the methods for dissolving hydrogencarbonate ion in water.

A water-soluble cutting fluid can be also obtained by preparing a solution containing a high concentration of bromide ion, hydrogencarbonate ion, carbonic acid ion, and if necessary, fluoride ion, and then appropriately diluting the solution with water to arbitrarily adjust an ion concentration of said solution. The pH of the water used to dilute the solution is not particularly limited.

The concentrations of bromide ion, carbonic acid ion, hydrogencarbonate ion, and, if necessary, fluoride ion are not particularly limited. However, in the case that the concentrations of these substances are considerably low in a cutting fluid, the cutting fluid does not work effectively in metal-working. Higher concentrations of these substances may lead to higher cutting efficiency. However, when these concentrations are reached at a certain level, cutting efficiency is no longer increased. Therefore, unnecessarily high concentrations of these substances are not preferable because they uselessly raise the cost and make it difficult to prepare a water-soluble cutting fluid. The optimum concentration of each ion in a water-soluble cutting fluid may vary with a kind of the metal of a workpiece. A workpiece, which is mainly made of iron, can be worked by using a cutting fluid with low ion concentration. However, in the case of working nonmetal, a cutting fluid with high ion concentration should be used.

A water-soluble cutting fluid of the present invention can be used as a substitute for a conventional cutting oil. Such water-soluble cutting fluid can be prepared by dissolving sodium carbonate and sodium bromide, and if necessary, sodium hydrogencarbonate and sodium fluoride.

However, a method for preparing the cutting fluid of the present invention is not limited by the above. Therefore, a water-soluble cutting fluid of the present invention can be prepared by dissolving salt containing cations such as potassium, calcium, and the like, as a substitute for sodium. A water-soluble cutting fluid of the present invention may contain 0.1 to 10 wt % of sodium carbonate and 0.005 to 1 wt % of sodium bromide, and , if necessary, 0.1 to 10 wt % of sodium hydrogencarbonate and 0.01 to 1 wt % of sodium fluoride.

Furthermore, a water-soluble cutting fluid of the present invention may contain various kinds of additives; for example, rust-preventive agents to prevent a tool and a workpiece from rusting; antiseptic agents to prevent repeatedly-used cutting fluid from spoiling; volatile components including alcohols solvent to promote cooling of a tool and a workpiece; brightener to provide burnish the surface of a workpiece, especially in grinding and polishing works; and substances to strengthen lubricity, e.g., starch and the like. Any rust-preventive agent commercially available can be used in the present invention.

For example, such rust-preventive agents as ion coat type agent, paraffin wax, and carnauba wax can be used. More specifically, the RUSTCOAT series solvent cutback type rust-preventive agent produced by Showa Shell Sekiyu K.K., Radiator Protector produced by SOFT 99 CORPORATION, carnauba wax produced by Ishihara Chemical Co., Ltd. and the like can be taken as an example.

As an antiseptic agent, such well-known antiseptic agents and bactericides as dehydroacetic acid, cresol, ethylene diamine and the like can be used.

As a alcohols solvent, such well-known solvents as methanol, ethanol, isopropanol and the like can be used.

As a brightener, benzothiazoline or the like can be used.

As a starch, cornstarch, potato starch and the like can be used. However, starch used in the present invention is not limited by the above.

As the need arises, various fats, oils, surface active agents and glycerol such as ethyleneglycol can be added to prepare a water-soluble cutting fluid of the present invention. Kinds and amounts of these additives may vary with kinds of a metal workpiece.

The concentration of the rust-preventive agent in the cutting fluid is not particularly limited, however, preferably 0.1 to 2 wt % and, more preferably, 0.5 to 2 wt % of a total amount of the cutting fluid.

The concentration of alcohols solvent in the cutting fluid is not particularly limited, however, preferably 0.1 to 10 wt%.

A water-soluble cutting fluid of the present invention can be used as a substitute for a conventional cutting oil or fluid in cutting metals and nonmetals.

As a cutting tool, single-point tools such as a bite, multiple-point tools such as a drill, a reamer, a milling cutter, a broach, a saw and a shank, grinding tools such as a bonded abrasive and loose abrasive, and formed tool or cutter, which cutting edge have the same shape as a specific outline of a product, can be used in the present invention. As a material of a cutting tool, carbon tool steel, high-speed steel, cast nonferrous alloys, cemented carbides, cemented oxides, diamonds, artificial abrasive grain and the like can be used.

As a workpiece, bar steels such as a round bar, a square bar and a hexagonal bar steel, steel plates and the like can be used in the present invention. More specifically, the followings can be used as a workpiece; a structural rolled steel, a carbon steel, a molybdenum steel plate, a round bar for rivet, a chain bar, a rolled steel for the purpose of welding, a hot rolled mild steel plate and a steel plate in coil, a cold rolled steel and a steel plate in coil, a carbon steel tube for general structural purpose, a carbon steel tube for machine structural use, a carbon steel pipe for ordinary piping, a carbon steel pipe for pressure piping, a carbon steel pipe for high pressure piping, a carbon steel pipe for high temperature piping, alloy steel pipe for ordinary piping, low carbon steel wire rod, high carbon steel wire rod, carbon steel for machine structural use, nickel, chrome steel, aluminum, chrome, molybdenum steel, stainless steel, oxygen free cooper, tough pitch copper, deoxidized copper, brass, magnesium alloy die casting, white metal, titanium, titanium alloy and the like. However, workpieces used in the present invention are not limited by the above. A water-soluble cutting fluid of the present invention can be also used to cut nonmetals such as glasses, ceramics, special earthenware, reinforced plastics and the like. Furthermore, a water-soluble cutting fluid of the present invention can be used in rock drilling by shield tunneling method.

A water-soluble cutting fluid of the present invention can prevent such damages as damage by heat of a cutting tool, destruction of a cutting blade and increasing abrasion of a cutting blade.

A water-soluble cutting fluid of the present invention, for example, is supplied to a pomp of a circular sawing machine, a bench drilling machine, a turning machine, a rock drill and the like and is used as a substitute for a conventional cutting fluid or a lubricant to cut a round bar, to drill, and to produce a flange surface.

A water-soluble cutting fluid of the present invention is characterized by lower viscosity than conventional cutting oil containing mineral oil as a base, smooth liquid current, excellent circulation in a pomp and no loading. Moreover, a proper viscosity resulting from a hydroxyl ion as well as fluoride ions in a polymer-like state contribute an excellent lubricity and excellent cooling property to prevent frictional heat produced between a tool and a workpiece to water-soluble cutting fluid of the present invention, so that the effective tool life can be increased with the use of the fluid.

A water-soluble cutting fluid of the present invention will be more clearly understood by referring to the Examples below. However, the Examples should not be construed to limit the invention in any way. It will be apparent to one of ordinary skin in the art that various changes and modifications can be made thereto without departing from the spirit or scope of the present invention.

EXAMPLES

Preparation of Water-soluble Cutting Fluid I 5 g of starch was added to 1 litter of distilled water, the mixture was boiled for one minute and then it was cooled to a room temperature. 50 g of sodium carbonate, 30 g of sodium hydrogencarbonate, 1 g of sodium bromide, 5 g of sodium fluoride, 2 cc of ethanol, 0.5 g of dehydroacetic acid, 10 cc of cresol and soap solution and 10 cc of THIOLIGHT 500 (produced by CHIYODA CHEMICAL CO., LTD.) were added to the cooled solution to prepare a concentrated water-soluble cutting fluid of the present invention. The pH of this fluid is 11.5 at the temperature of 25° C. After diluting the fluid ten times with water, following tests described in Examples 1 to 10 were conducted.

Examples 1 to 5

A water-soluble cutting fluid of the present invention was supplied to a machining center. Cutting tests of aluminum, stainless steel, iron, and copper were conducted under various cutting conditions as shown in Table 1. In the same manner, comparative tests were conducted by supplying a conventional cutting fluid including chlorine to the machining center.

The results of durability of the cutting tools (the number of workpieces cut by a cutting tool) and the detailed cutting conditions are shown in Table 1.

TABLE 1

| MATERIAL | MACHINE | METHOD | TOOL | CUTTING SPEED | FEEDING SPEED (mm/rev) | CONVENTIONAL CUTTING FLUID:CUTTING FLUID OF THE PRESENT INVENTION |
|---|---|---|---|---|---|---|
| Aluminium Die-Casting ADC12 | machining center | ϕ 15 end milling work | high-speed steel end mill | 2500 rpm | 300 | 1100:1200 |
| | | ϕ 3 drilling work | high-speed steel coated drill | 6000 rpm | 0.15 | 13000:14500 |
| | | M3 tapping work | high-speed steel rolled tap | 5000 rpm | — | 50000:55000 |
| Alminium Round Bar 2017 | machining center | ϕ 12 end milling work | cemented carbide endmill | 4000 rpm | 500 | 5500:6000 |
| | | ϕ 25 drilling work | cemented carbide drill | 3000 rpm | 0.12 | 5600:5800 |
| | | M16 rolled tapping work | cemented carbide rolled tap | 800 rpm | — | 30000:35000 |
| SUS304 | machining center | ϕ 15 end milling work | high-speed steel coated end mill | 400 rpm | 100 | 300:300 |
| | | ϕ 10 deep-hole drilling work | high-speed steel coated drill | 750 rpm | 0.15 | 250:250 |
| | | M4 tapping work | high-speed steel coated rolled tap | 550 rpm | — | 1500:1500 |
| S45C | machining center | ϕ 15 end milling work | high-speed steel end mill | 700 rpm | 130 | 1000:1000 |
| | | ϕ 14 drilling work | high-speed steel drill | 2800 rpm | 0.1 | 850:850 |
| Copper | machining center | ϕ 9.3 drilling work | high-speed steel coated drill | 1800 rpm | 0.15 | 1000:1000 |
| | | M10 rolled tapping work | high-speed steel coated rolled tap | 800 rpm | — | 5000:5000 |

Examples 6 to 10

A water-soluble cutting fluid of the present invention was supplied to the NC lathe. Cutting tests of aluminum, stainless steel, iron, and copper were conducted under various cutting conditions as shown in Table 2. In the same manner, comparative tests were conducted by supplying a conventional chlorine cutting fluid to the NC lathe.

The results of durability of the cutting tools (the number of workpieces cut by a cutting tool)and the detailed cutting conditions are shown in Table 2.

TABLE 2

| MATERIAL | MACHINE | METHOD | TOOL | CUTTING SPEED | FEEDING SPEED (mm) | CONVENTIONAL CUTTING FLUID:CUTTING FLUID OF THE PRESENT INVENTION |
|---|---|---|---|---|---|---|
| Aluminium Die-Casting ADC12 | NC lathe | bore roughing | diamond | 1000 rpm | 0.15 | 20000:20000 (pieces) |
| | | bore finishing | diamond | 1000 rpm | 0.08 | 35000:38000 |
| | | end face roughing | diamond | 1000 rpm | 0.1 | 28000:30000 |
| Alminium Round Bar 2017 | NC lathe | outer roughing | cemented carbide | 600 rpm | 0.2 | 5200:5200 |
| | | outer finishing | | 600 rpm | 0.08 | 6500:6800 |
| | | outer grooving | | 600 rpm | 0.08 | 5000:5500 |
| | | outer screw HIKARI M20 | | 600 rpm | | 12000:12000 |
| SUS304 | NC lathe | outer roughing | coating | 130 rpm | 0.2 | 250:250 |
| | | outer finishing | cermet | 180 rpm | 0.1 | 500:550 |
| | | outer grooving | cermet | 100 rpm | 0.1 | 430:430 |
| | | bore finishing | cermet | 150 rpm | 0.08 | 550:550 |
| S45C | NC lathe | outer roughing | coating | 180 rpm | 0.3 | 360:360 |
| | | outer finishing | cermet | 250 rpm | 0.08 | 680:700 |
| | | bore roughing | coating | 160 rpm | 0.2 | 350:350 |
| | | bore finishing | cermet | 200 rpm | 0.08 | 650:660 |
| | | outer screw HIKARI M20 | coating | 120 rpm | | 480:480 |
| Copper | NC lathe | outer roughing | cermet | 250 rpm | 0.13 | 500:500 |
| | | end face roughing | cermet | 250 rpm | 0.12 | 500:500 |

Preparation of Water-soluble Cutting Fluid II 10 wt % of 1,2-benzoisothiazoline-3-on, 4 wt % of 2-pyridinethiol sodiumoxide, and 9.6 wt % of ethylene diamine were mixed with 76.4 wt % of distilled water to prepare 100 wt % of water-soluble cutting fluid I .

50 g of sodium carbonate, 3 g of sodium bromide, and 300 cc of THIOLIGHT 500 (produced by CHIYODA CHEMICAL CO., LTD) to prepare water-soluble cutting fluid II. Concentrated water-soluble cutting fluid of the present invention was prepared by mixing 100 cc of the cutting fluid I and 1300 cc of the cutting fluid II. The pH of the mixture was 11.83 at the temperature of 25° C. This mixture was diluted 30 times with water and then the following tests were conducted in EXAMPLE 11.

Example 11

The grinding tests were conducted by using the cutting fluid II. The cutting fluid II was supplied to the OKAMOTO IGM-type grinding machine with a grind wheel #60, which inner diameter is 10 mm and which outer diameter is 150 mm. As a grinding steel product, SCM435 and SCM412 shafts, which diameters were from 30 mm to 50 mm, were used. The grinding machine was operated at 120 r.p.m. and 500 mm per second of feeding speed in roughing, and 800 mm per second of feeding speed in finishing. Comparative tests were conducted by using conventional grinding fluids, Neocool and UK-465, which were used after being diluted 40 times and 30 times with water, respectively. As the result of the test, it could be found that the cutting fluid II had the same effect as Neocool, thus preventing loading of the grinding wheel effectively. As compared to UK-465, the cutting fluid II produced less loading of the grinding wheel than UK-465, and was more than 20% or more effective than UK-465. In another words, in the case of using the cutting fluid II of the present invention, the number of revolution of the grinding wheel was reduced by 20%, compared to that of UK-465.

INDUSTRIAL APPLICABILITY

A water-soluble cutting fluid, which is used as a substitute for conventionally-used cutting oil or cutting fluid including chlorine, can be obtained according to the present invention. Said water-soluble cutting fluid is characterized by low viscosity, excellent liquid flow in a parmp, and excellent lubricating and cooling properties. Therefore, a water-soluble cutting fluid of the present invention increases the useful life of a cutting tool and improves the operation efficiency. Moreover, waste fluid of a water-soluble cutting fluid of the present invention does not include environmentally- hazardous substances, e .g., chlorine, which lead to the generation of dioxin, and other toxic substances. Therefore, it does not exert a bad influence on the environment.

What is claimed is:

1. A water-soluble cutting fluid comprising bromide ion, carbonic acid ion and hydrogencarbonate ion, and having a pH of 7.0 to 11.5.

2. A water-soluble cutting fluid according to claim 1, wherein said cutting fluid mainly comprises a a solution of sodium carbonate and sodium bromide.

3. A water-soluble cutting fluid according to claim 1, wherein said cutting fluid mainly comprises bromide ion, carbonic acid ion, hydrogencarbonate ion, and fluoride ion, and has a pH of 7.0 to 11.5.

4. A water-soluble cutting fluid according to claim 1, wherein said cutting fluid mainly comprises a solution of sodium carbonate, sodium hydrogencarbonate, sodium bromide and sodium fluoride.

5. A water-soluble cutting fluid according to, claim 1 wherein said cutting fluid further comprises one or more additives.

6. A water-soluble cutting fluid according to claim 5, wherein said additives comprises one or more types selected from a group consisting of alcohol solvents, rust-preventive agents, brighteners, and antiseptic agents.

* * * * *

UNITED STATES PATENT AND TRADEMARK OFFICE

CERTIFICATE OF CORRECTION

PATENT NO. : 6,242,391 B1
DATED : June 5, 2001
INVENTOR(S) : Yasuo Fukutani, Eiichiro Nakayama, Yukio Wada and Shunji Suzuki It is certified that error appears in the above-identified patent and that said Letters Patent is hereby corrected as shown below:

Title page,
Item [73] Assignee change "Yasio" to Yasuo --

Signed and Sealed this

Twenty-first Day of May, 2002

*Attest:*

*Attesting Officer*

JAMES E. ROGAN
*Director of the United States Patent and Trademark Office*